US008806908B2

(12) United States Patent
Yu et al.

(10) Patent No.: US 8,806,908 B2
(45) Date of Patent: Aug. 19, 2014

(54) DUAL KEY BI-STEP LOCK

(76) Inventors: Yongyao Yu, Ningbo (CN); Jun Hu, Ningbo (CN); Zhongwei Cao, Ningbo (CN)

( * ) Notice: Subject to any disclaimer, the term of this patent is extended or adjusted under 35 U.S.C. 154(b) by 52 days.

(21) Appl. No.: 13/321,549

(22) PCT Filed: May 20, 2010

(86) PCT No.: PCT/CN2010/000711

§ 371 (c)(1),
(2), (4) Date: Nov. 20, 2011

(87) PCT Pub. No.: WO2010/133091

PCT Pub. Date: Nov. 25, 2010

(65) Prior Publication Data

US 2012/0060571 A1 Mar. 15, 2012

(30) Foreign Application Priority Data

May 20, 2009 (CN) ..... 2009 1 0098924

(51) Int. Cl.
*E05B 35/08* (2006.01)

(52) U.S. Cl.
USPC ..... 70/337; 70/339; 70/358; 70/493; 70/214; 70/DIG. 63; 109/59 T

(58) Field of Classification Search
USPC ..... 5/493, 358, 337–343, 277, 278.1, 5/278.7, 279.1, 283–285, 214, DIG. 63, 5/494, 495, 378, DIG. 37; 109/59 R, 59 T; 70/493, 358, 337–343, 277, 278.1, 70/278.7, 279.1, 283–285, 214, DIG. 63, 70/494, 495, 378, DIG. 37
See application file for complete search history.

(56) References Cited

U.S. PATENT DOCUMENTS

| | | | | |
|---|---|---|---|---|
| 4,137,739 | A * | 2/1979 | Keller | 70/358 |
| 4,403,486 | A * | 9/1983 | Miyake | 70/338 |
| 6,860,131 | B2 * | 3/2005 | Armstrong et al. | 70/492 |
| 8,109,122 | B2 * | 2/2012 | Herdman | 70/493 |
| 2003/0159483 | A1 * | 8/2003 | Kondratuk et al. | 70/493 |

* cited by examiner

*Primary Examiner* — Lloyd Gall
*Assistant Examiner* — Duoni Pan

(57) ABSTRACT

A dual key bi-step lock having a shell and a cylindrical plug in the shell. The plug has a primary keyway and a secondary keyway and at least one set of primary pin stack and at least one set of secondary pin stack between the shell and the plug, respectively coupling with the primary and the secondary keys. a longitudinal stage is formed on a cylindrical surface of the plug. An involute side face extending from the stage to the cylindrical surface of the plug. The primary key is able to dive the plug to a position of first step open at which the stage is stopped by the key pin of the secondary pin stack. The secondary pin stack is unlocked by the secondary key and the plug is able to be further driven to a position of second step open by the primary and the secondary keys from the first step open.

4 Claims, 11 Drawing Sheets

DUAL KEY BI-STEP LOCK

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a dual key bi-step lock, and more particularly, to a lock having a primary key and a secondary key which is able to be used as a universal key or an emergent key.

2. Description of Related Art

A conventional pin tumbler lock usually has a shell having formed therein a central cylindrical opening in which is located a plug. The shell further has formed therein a set of chambers, each of which is a radially extending bore adapted to receive therein a pin stack which includes a compression spring, a driver pin, and a key pin. The key pin is outermost, and is supported on the driver pin, which is seated in turn on the compression spring, which assists in forcing the key pin across a shear line and into the keyway formed in the plug, so as to block rotation thereof within the cylinder. In this position, the lock cannot be opened without a key. The driver pins are of uniform length, while the key pins are of different lengths.

Chinese patent ZL93243828.8 discloses a pin tumbler lock having a universal key. For one batch of this kind of lock, the universal key is able to open all the locks but the special key is only able to open one special matching lock. For this kind of lock, either the universal key or the special key will be able to open one special lock individually. It is desired that a lock is only able to be opened when the universal key and the special key are both inserted in a keyway of the lock.

BRIEF SUMMARY OF THE INVENTION

The main object of the invention is to provide a dual key bi-step lock which is only able to be opened when a universal key and a special key thereof are both inserted in a keyway thereof.

In order to achieve above object, the invention provides a dual key bi-step lock having a shell and a cylindrical plug in the shell. The plug has a primary keyway and a secondary keyway, at least one set of primary pin stack and at least one set of secondary pin stack provided between the shell and the plug, respectively coupling with the primary and the secondary keys. Each set of the primary and the secondary pin stacks has a compression spring, a driver pin, and a key pin. The key pin is outermost and being supported on the driver pin, which is seated on the compression spring, which assists in forcing the key pin across a shear line and into the corresponding keyway formed in the plug. A longitudinal stage is formed on a cylindrical surface of the plug and an involute side face extends from the stage to the cylindrical surface of the plug. A primary key is provided for the primary keyway and a secondary key for the secondary keyway, wherein when the primary key is inserted in the primary keyway and rotated, the primary key is able to dive the plug to a position of first step open at which the stage is stopped by the key pin of the secondary pin stack, and when the secondary key is inserted in the secondary keyway and rotated together with the primary key, the secondary pin stack is unlocked by the secondary key and the plug is able to be further driven to a position of second step open by the primary and the secondary keys from the first step open.

These and other objectives, features, and advantages of the present invention will become apparent from the following detailed description, the accompanying drawings, and the appended claims.

DETAILED DESCRIPTION OF THE INVENTION

Figure 1:
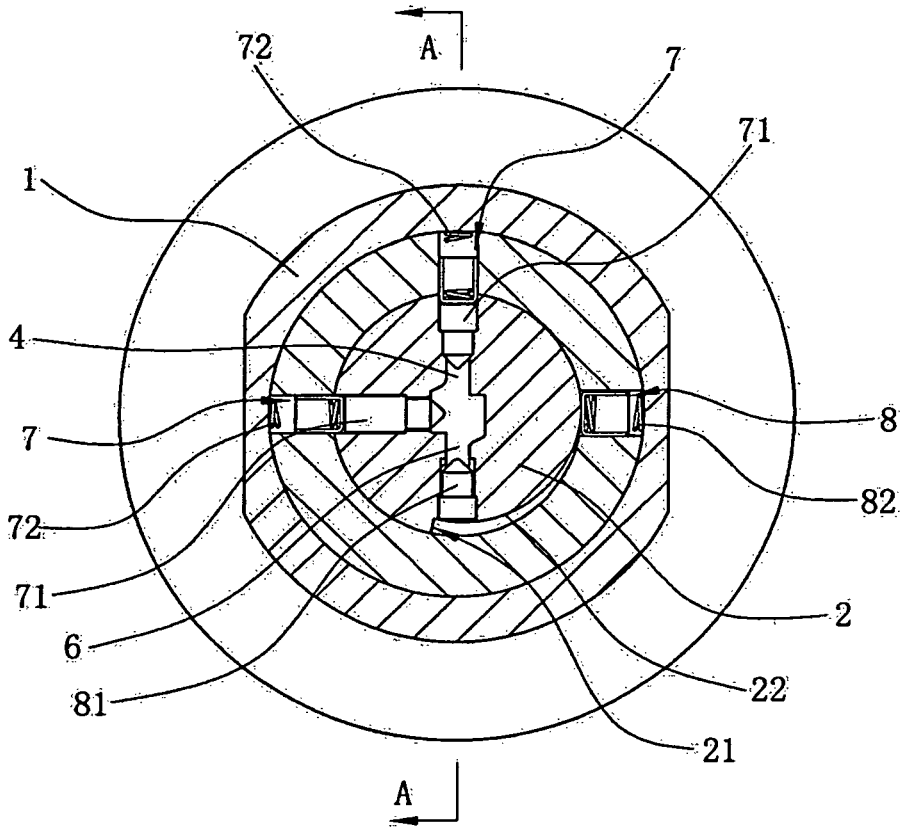
FIG. 1 is a cross-sectional view of the preferred embodiment of the dual key bi-step lock of the invention when the lock is locked.
Figure 2:
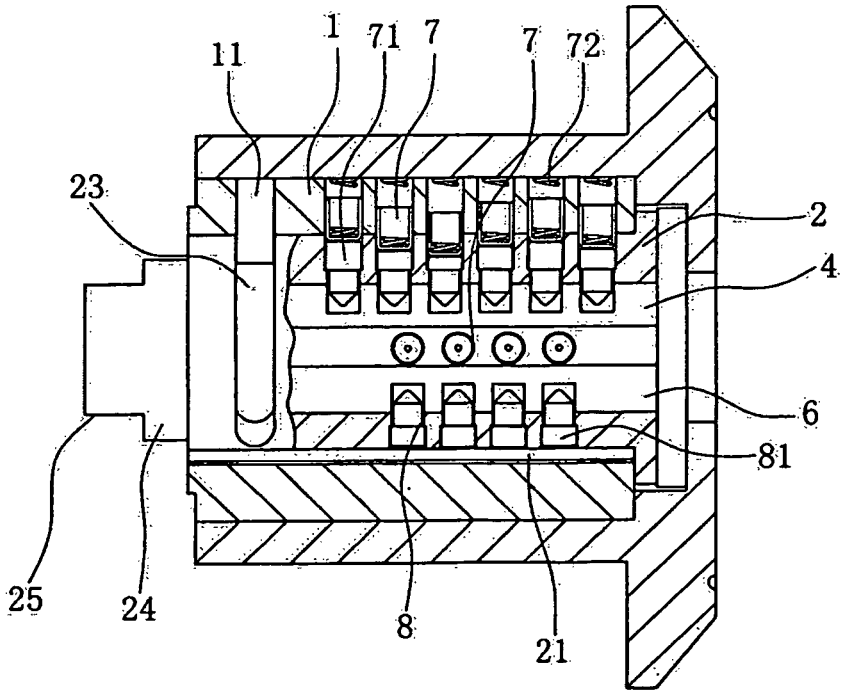
FIG. 2 is a cross-sectional view along A-A line in FIG. 1.
Figure 3:
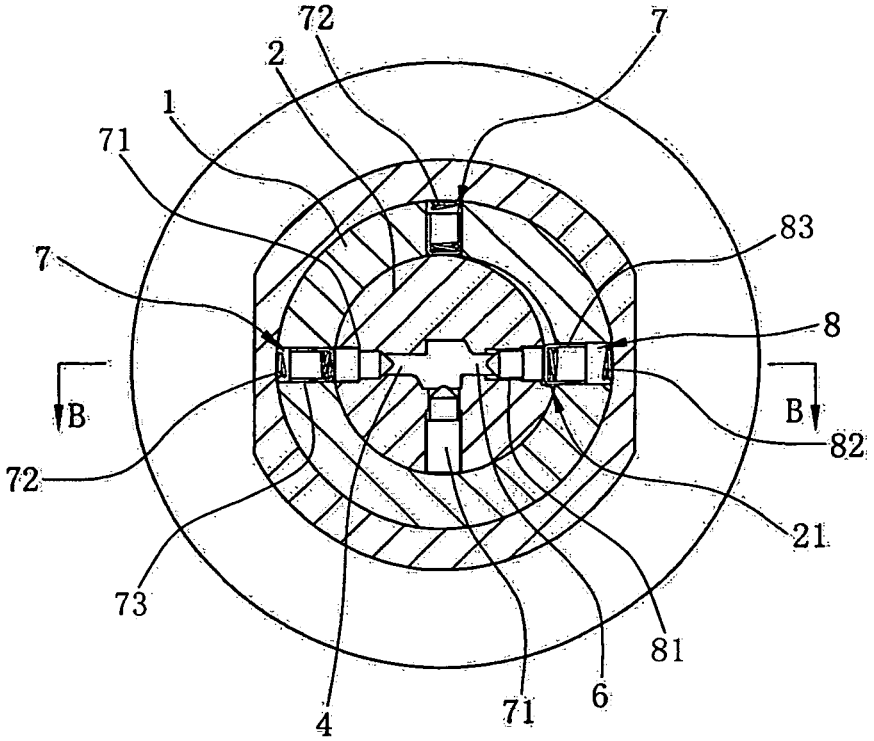
FIG. 3 is a plane view thereof when the lock is first step opened.
Figure 4:
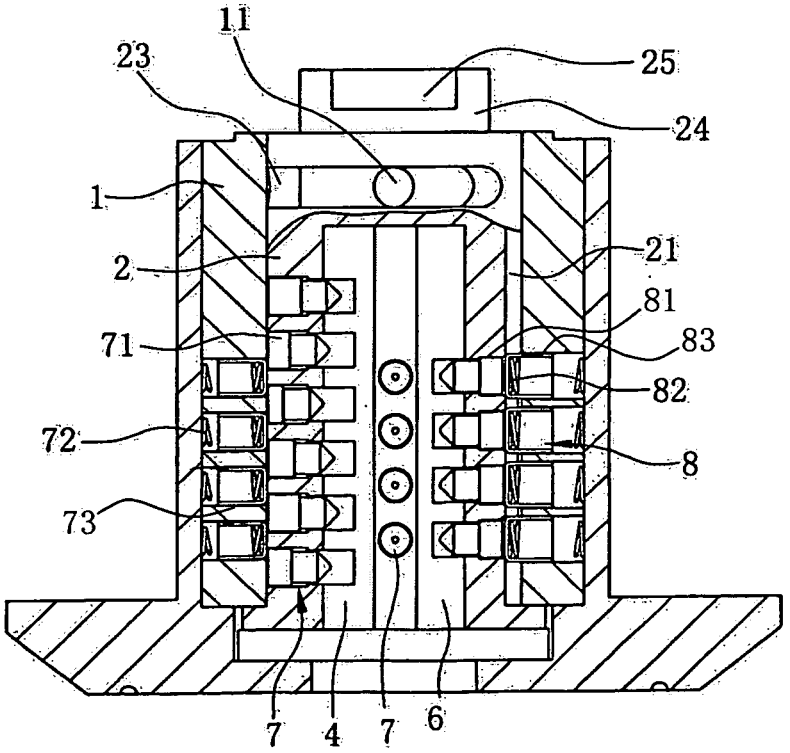
FIG. 4 is a cross-sectional view along B-B line in FIG. 3.
Figure 5:
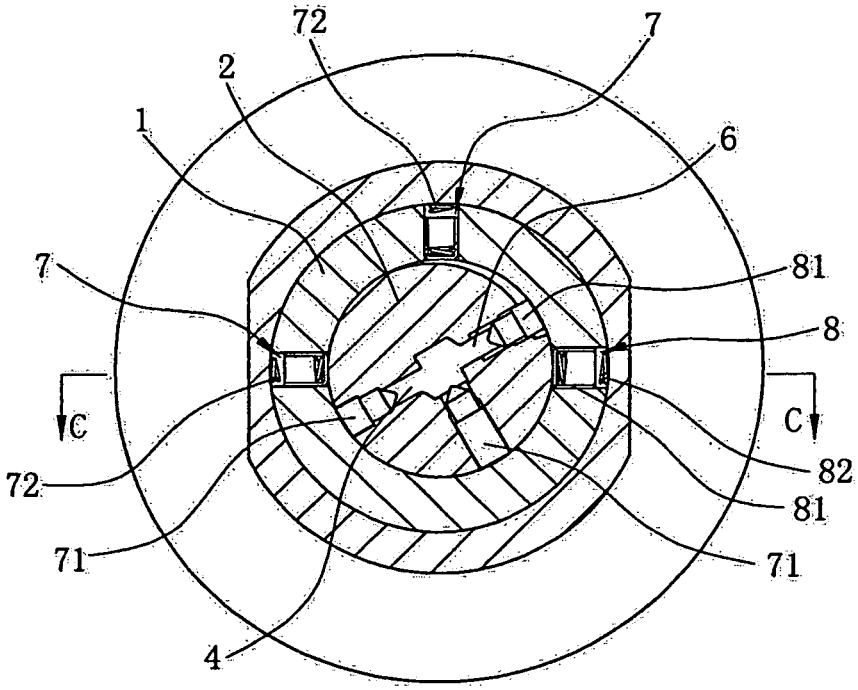
FIG. 5 is a plane view thereof when the lock is second step opened.
Figure 6:
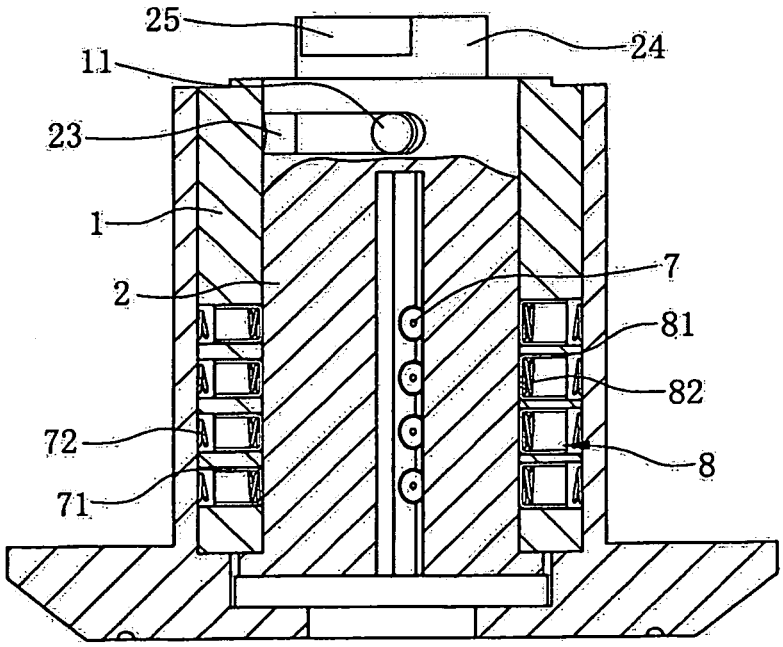
FIG. 6 is a cross-sectional view along C-C line in FIG. 5.
Figure 7:
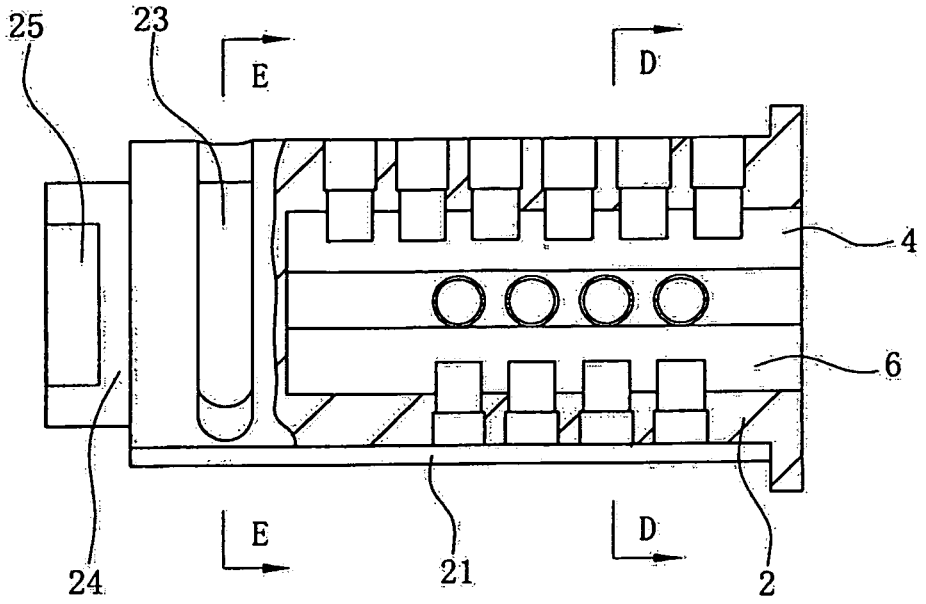
FIG. 7 is a partial plane view showing a plug thereof.
Figure 8:
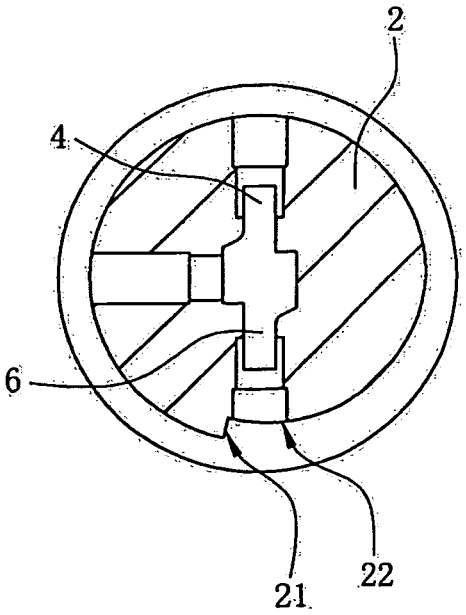
FIG. 8 is a cross-sectional view along D-D line in FIG. 7.
Figure 9:
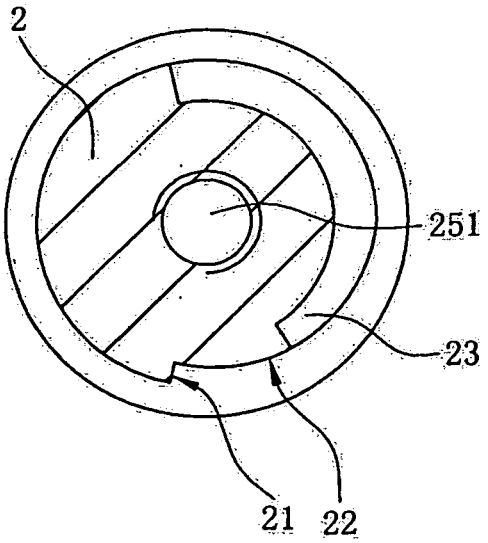
FIG. 9 is a cross-sectional view along E-E line in FIG. 7.
Figure 10:
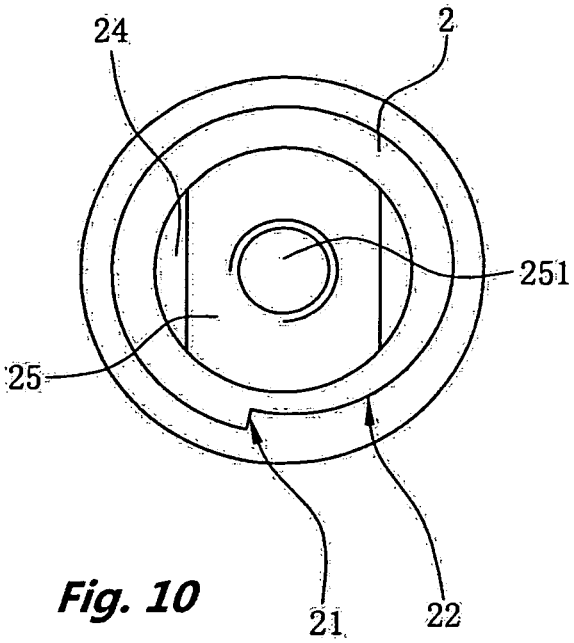
FIG. 10 is a left side view of FIG. 7.
Figure 11:
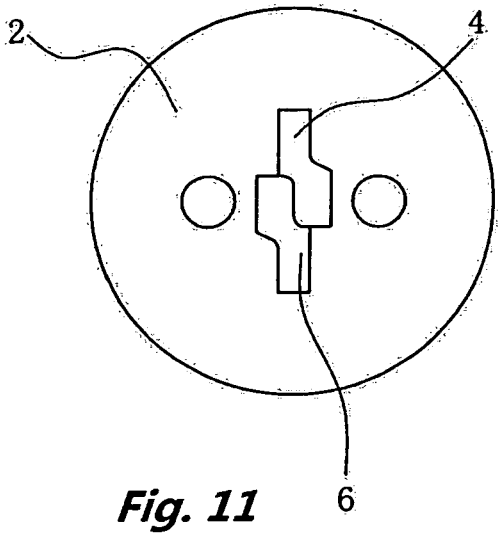
FIG. 11 is a right side view of FIG. 7.
Figure 12:
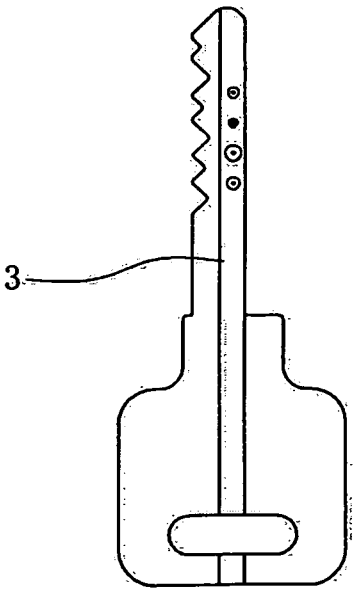
FIG. 12 is a schematic plane view of a primary key of the invention.
Figure 13:
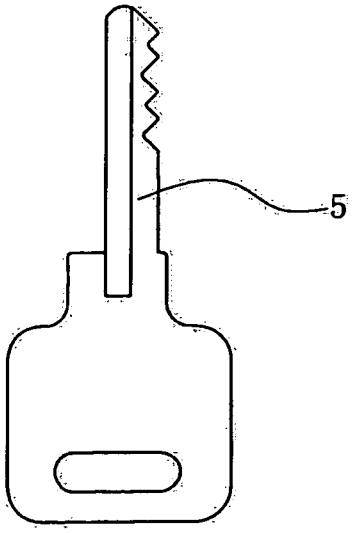
FIG. 13 is a schematic plane view of a secondary key of the invention.

With reference to FIGS. 1 through 13, the preferred embodiment of a dual key bi-step lock of the invention is shown. The lock has a shell 1 and a cylindrical plug 2 in the shell 1. The plug 2 has a primary keyway 4 for a primary key 3 and a secondary keyway 6 for a secondary key 5. As particularly shown in FIG. 11, the primary and the secondary keyways 4 and 6 are contiguous in this preferred embodiment. They are able to be separate with each other in the plug 2.

At least one set of primary pin stack 7 and at least one set of secondary pin stack 8 are provided between the shell 1 and the plug 2, respectively coupling with the primary and the secondary keys 3 and 5. There are two sects of primary pin stack 7 and one set of secondary pin stack 8 in this preferred embodiment and there might be more than this quantity. Each set of the primary and the secondary pin stacks 7 or 8 has a compression spring 72 or 82, a driver pin 73 or 83, and a key pin 71 or 81. The key pin 71 or 81 is outermost and is supported on the driver pin 73 or 83, which is seated on the compression spring 72 or 82, which assists in forcing the key pin 71 or 81 across a shear line and into the keyways 4 or 6 formed in the plug 2. A structure and working of the sets of pin stacks 7 and 8 are as same as the conventional pin tumbler locks and will not be discussed here in detail.

There is a longitudinal stage 21 formed on a cylindrical surface of the plug 2. An involute side face 22 extends from the stage 21 to the cylindrical surface of the plug 2. The involute side face 22 may cover about, preferably, 90 degree.

When inserted in the primary keyway 4, the primary key 3 is able to unlock the plug 2 from the shell 1 by the primary pin stacks 7, making a rotation of the primary key 3 be able to drive the plug 2 to rotate with respect to the shell 1 to a position of first step open until the stage 21 meets and is stopped by the key pin 81 of the secondary pin stacks 8.

In the position of first step open when the stage 21 is blocked by the key pin 81 of the secondary pin stacks 8, the secondary key 5 is able to be inserted in the secondary keyway 6. The secondary key 5 is able to unlock the plug 2 from the shell 1 by the secondary pin stacks 8. When the primary and the secondary keys 3 and 5 are rotate at this same time, the plug 2 is able to rotate with respect to the shell 1 to a position of second step open.

A cross groove 23 is defined in the cylindrical surface of the plug 2 and a pin 11 is formed on an inner surface of the shell 1 and slidably contained in the cross groove 23. A movement of the pin 11 is limited by two ends of the cross groove 23, which are respectively corresponding to a locked position and second step open position of the plug 2 with respect to the shell 1.

A secondary shaft 24 is formed on an inner end of the plug 2 and a primary shaft 25 is formed on a free end of the secondary shaft 24. A secondary pick 10 is provided having a hole 102 slidably covering on the secondary shaft 24 and a primary pick 9 is provided having a profile hole 92 fixedly covering on the primary shaft 25. A screw hole 251 is defined in a side surface of the primary shaft 25. A screw 12 is able to insert the screw hole 251 to limit the primary pick 9 from falling off from the primary shaft 25. A driving pillar 91 is formed on the primary pick 9 and slidably contained in an arc-shaped guiding groove 101 defined in the secondary pick 10. The guiding groove 101 has two ends and a degree of an arc thereof is as same as the degree the plug 2 rotates from the locked position to the first step open position.

Figure 14:
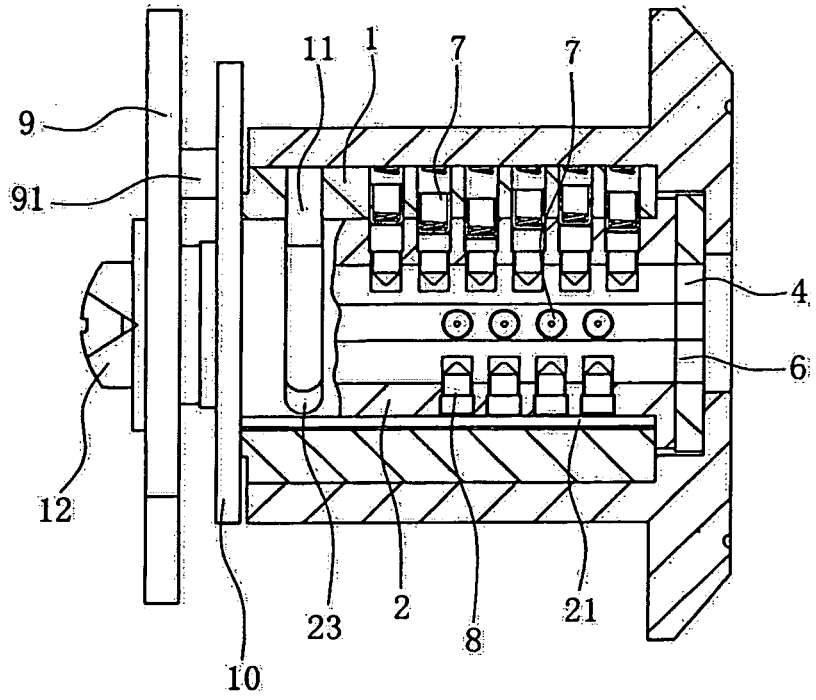
FIG. 14 is another cross-sectional view of the dual key bi-step lock of the invention when the lock is locked.
Figure 15:
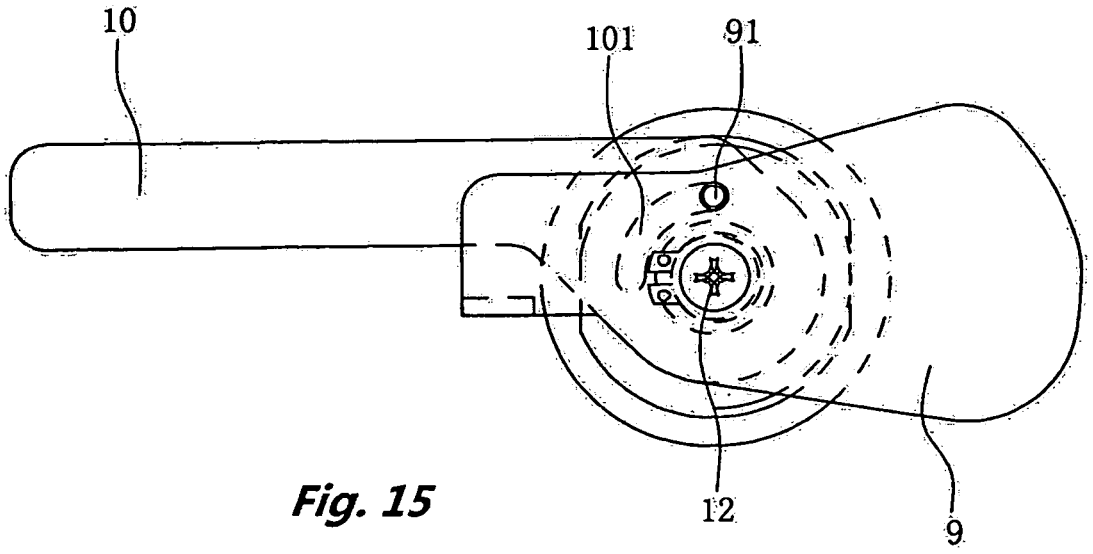
FIG. 15 is a left side view of FIG. 14.

In an open process as shown in FIGS. 14 and 15, the primary key 3 is able to be inserted into the primary keyway 4. The primary key 3 will push the key pin 71 of the primary pin stacks 7 to the shear line and unlock the plug 2 with respect to the shell 1. When the primary key 3 is rotated, the plug 2 and the primary pick 9 rotate accordingly. After a rotation of preferably 90 degree as in this embodiment, the stage 21 meets the key pin 81 of the secondary pin stacks 8 and the plug 2 stops. In this process, the plug 2 rotates with respect to the secondary pick 10. The driving pillar 91 of the primary pick 9 freely slides along the guiding groove 101 of the secondary pick 10 until meet two ends of the guiding groove 101. In a position of being locked, the primary pick 9 is able to actuate one block of a double insurance blocking mechanism controlling a slide plate of, for example, a safe door, to lock a bolting mechanism thereof. In a position of first step open, the primary pick 9 may release the one block of the double insurance blocking mechanism. In the first step open process, only the primary pick 9 rotates and the secondary pick 10 keeps stable.

Figure 16:
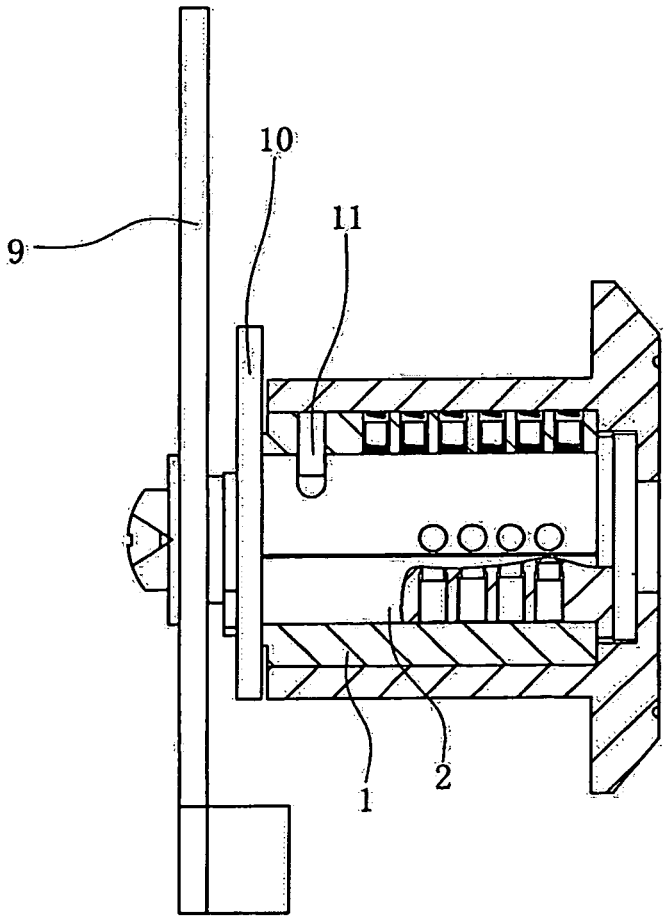
FIG. 16 is another partially cross-sectional view thereof when the lock is first step opened.
Figure 17:
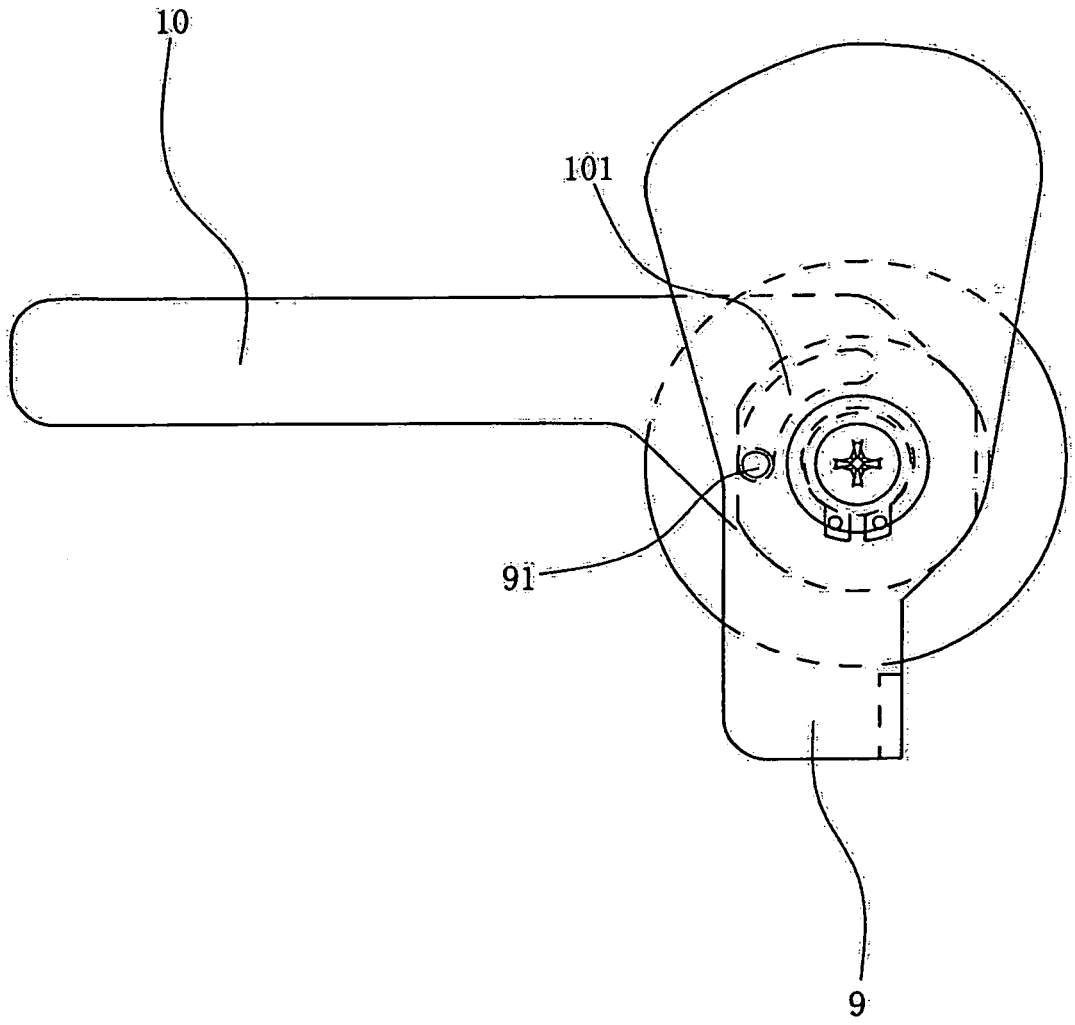
FIG. 17 is a left side view of FIG. 16.
Figure 18:
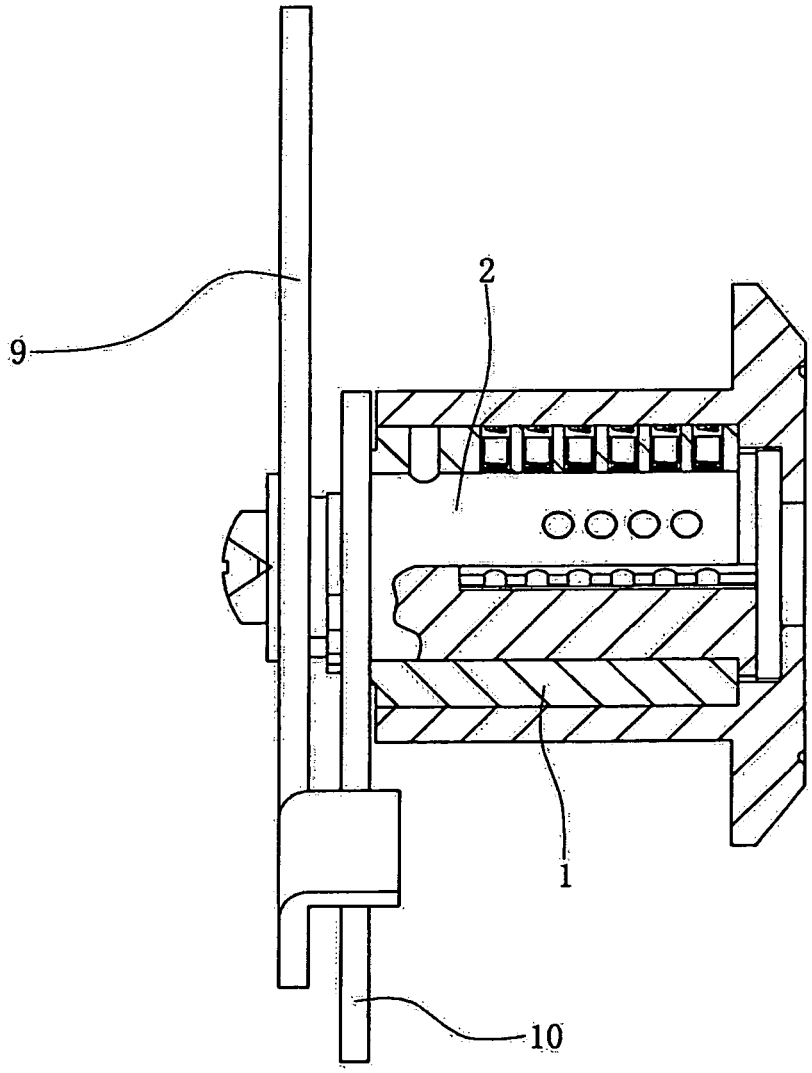
FIG. 18 is another partially cross-sectional view thereof when the lock is second step opened.
Figure 19:
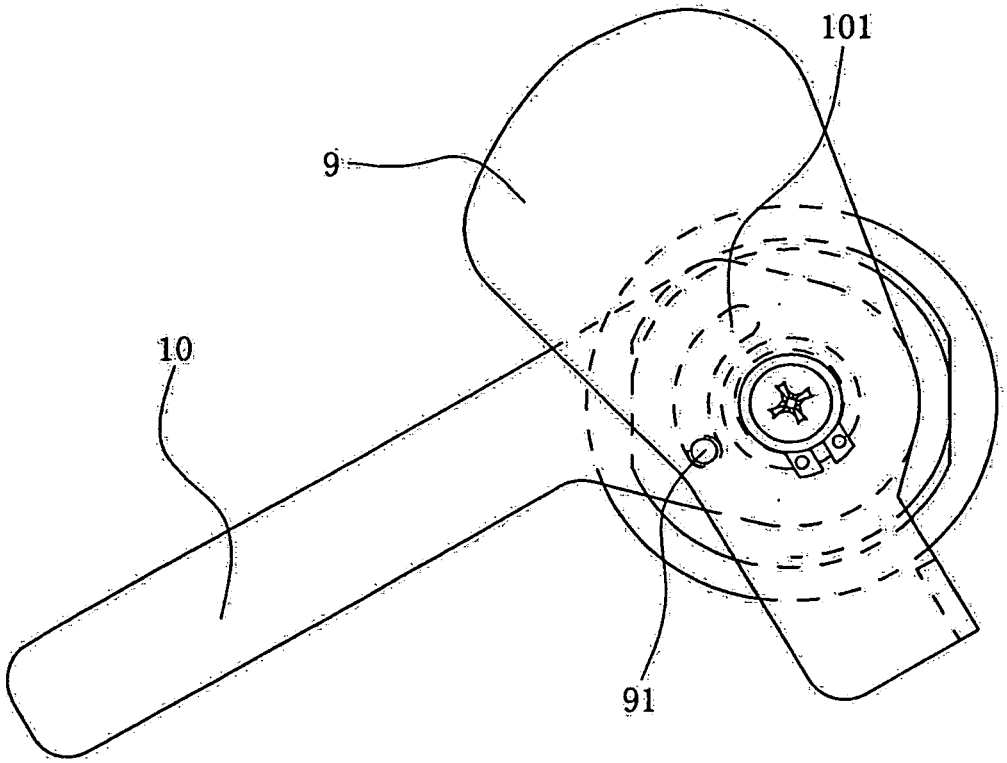
FIG. 19 is a left side view of FIG. 18.
Figure 20:
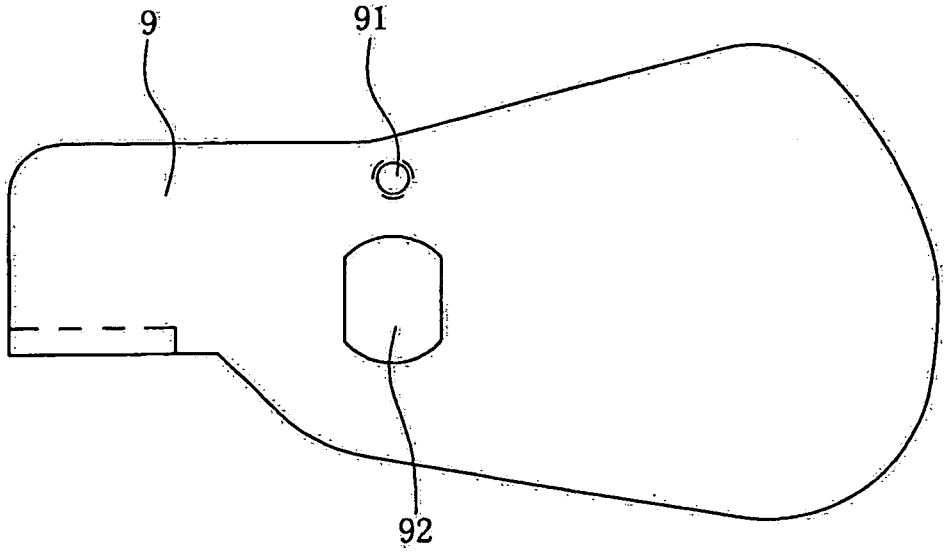
FIG. 20 is a plane side view of a primary pick of the invention.
Figure 21:
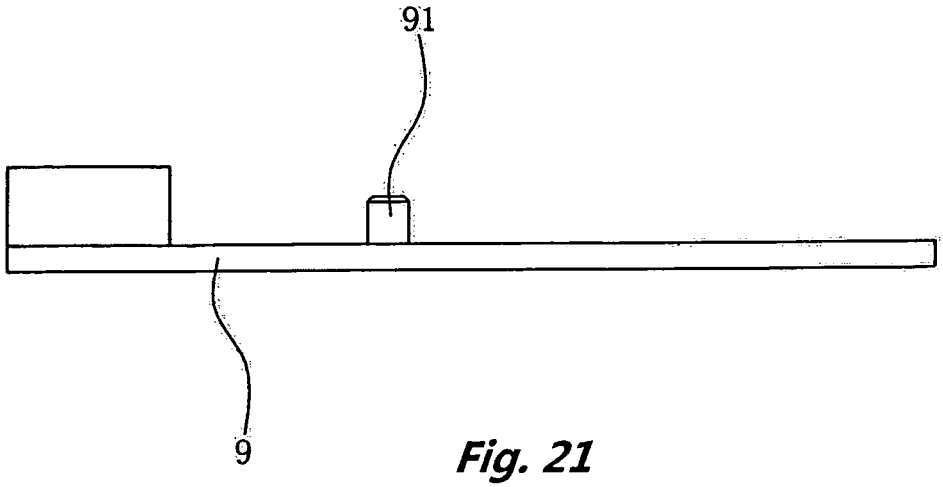
FIG. 21 is another plane side view of the primary pick of the invention. And, FIG. 22 is a plane side view of a secondary pick of the invention.
Figure 22:
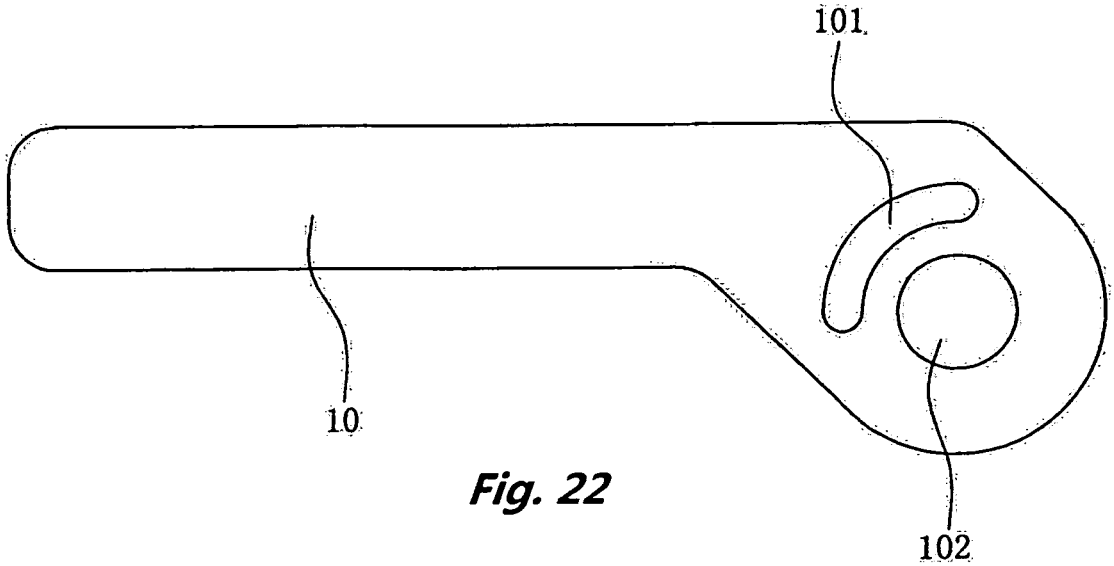

In a second step open as shown in FIGS. 16 and 17, the secondary key 5 is able to be inserted into the secondary keyway 6 together with the primary key 3 in the primary keyway 4. the key pin 81 of the secondary pin stacks 8 is pushed to the shear line by the secondary key 5 to unlock the stage 21. Rotate the primary and the secondary keys 3 and 5 together, the plug 2 will be able to rotate further from the position of first step open. The driving pillar 91 of the primary pick 9 will drive the secondary pick 10 to rotate until an end of the cross groove 23 meets and is stopped by the pin 11 of the shell 1. In this second step open, secondary pick 10 is able to actuate another block of the double insurance blocking mechanism controlling the slide plate to totally release the double insurance blocking mechanism to open the dual key by-step lock. A reverse operation will able to lock the lock. The double insurance blocking mechanism can be any conventional kind which has two same blocking means each controlled by one key. It is a conventional skill and will not be described here in detail.

Either the primary key 3 or the secondary key 5 can be used as a universal key and the other as a special key unless corresponding pin stacks, primary or the secondary pin stacks 7 or 8 in one batch are set to be universally the same and the other set be special. The secondary key 5 and the secondary pick 10 are also able to be used to mechanically open an electronic lock of safe door in emergency when the electronic lock malfunctions or an enter code thereof is forgotten.

From above description, it is seen that the objects of the present invention have been fully and effectively accomplished. Embodiment of the invention has been shown and described for the purposes of illustrating the functional and structural principles of the present invention and is subject to change without departure from the invention's principles. Therefore, this invention includes all modifications encompassed within the spirit and scope of the following claims.

The invention claimed is:

1. A dual key bi-step lock comprising:

a shell, a cylindrical plug in the shell, the plug having a primary keyway and a secondary keyway, at least one set of primary pin stack and at least one set of secondary pin stack provided between the shell and the plug, respectively coupling with the primary and a secondary key, each set of the primary and the secondary pin stacks having a compression spring, a driver pin, and a key pin, the key pin being outermost and being supported on the driver pin, which is seated on the compression spring, which assists in forcing the key pin across a shear line and into the corresponding keyway formed in the plug, a longitudinal stage formed on a cylindrical surface of the plug, an involute side face extending from the stage to the cylindrical surface of the plug, the primary key for the primary keyway, and the secondary key for the secondary keyway, wherein when the primary key is inserted in the primary keyway and rotated, the primary key is able to drive the plug to a position of first step open at which the stage is stopped by the key pin of the secondary pin stack, and when the secondary key is inserted in the secondary keyway and rotated together with the primary key, the secondary pin stack is unlocked by the secondary key and the plug is able to be further driven to a position of second step open by the primary and the secondary keys from the first step open.

2. The dual key bi-step lock as claimed in claim 1, wherein a cross groove is defined in the cylindrical surface of the plug and a pin is formed on an inner surface of the shell and slidably contained in the cross groove.

3. The dual key bi-step lock as claimed in claim 1, wherein a secondary shaft is formed on an inner end of the plug and a primary shaft is formed on a free end of the secondary shaft.

4. The dual key bi-step lock as claimed in claim 3, wherein a secondary pick is provided having a hole slidably covering on the secondary shaft and a primary pick is provided having a profile hole fixedly covering on the primary shaft.

* * * * *